United States Patent [19]

Goebbels et al.

[11] Patent Number: 4,998,490

[45] Date of Patent: Mar. 12, 1991

[54] BOBBIN HOUSING ASSEMBLY IN A SEWING MACHINE HAVING AT LEAST ONE HOOK

[75] Inventors: Hans R. Goebbels, Hiddenhausen; Kurt Biermann, Bielefeld; Gerhard Steppat, Bielefeld; Wilhelm Stapel, Bielefeld; Michael Rosemann, Bielefeld; Klaus D. Seiler, Kirchlengern, all of Fed. Rep. of Germany

[73] Assignee: Durkoppwerke GmbH, Fed. Rep. of Germany

[21] Appl. No.: 361,734

[22] Filed: Jun. 2, 1989

Related U.S. Application Data

[63] Continuation of Ser. No. 138,590, Dec. 28, 1987, abandoned.

[30] Foreign Application Priority Data

Dec. 30, 1986 [DE] Fed. Rep. of Germany ..... 3644711

[51] Int. Cl.[5] ..... D05B 57/26; D05B 57/08

[52] U.S. Cl. ..... 112/231

[58] Field of Search ..... 112/184, 228, 229, 231

[56] References Cited

U.S. PATENT DOCUMENTS

| | | | |
|---|---|---|---|
| 1,917,771 | 7/1933 | Myers | 112/228 |
| 4,137,858 | 2/1979 | Stapel et al. | 112/229 X |
| 4,527,494 | 7/1985 | Herron et al. | 112/231 |
| 4,691,650 | 9/1987 | Dusch | 112/231 |

FOREIGN PATENT DOCUMENTS

| | | | |
|---|---|---|---|
| 633067 | 7/1936 | Fed. Rep. of Germany | 112/228 |
| 2439214 | 2/1976 | Fed. Rep. of Germany | 112/231 |

*Primary Examiner*—Wm. Carter Reynolds

*Attorney, Agent, or Firm*—Ostrolenk, Faber, Gerb & Soffen

[57] ABSTRACT

A sewing machine has at least one rotating top thread hook, the hook enclosing a bobbin housing which accommodates a bottom thread. A spring bar is mounted in the base of the sewing machine and has a free end for bearing against the bobbin housing. The free end of the spring bar is displaceable by the top thread as it is being looped. To prevent unwanted displacement or oscillation of the spring bar, a cam is disposed in the base closely adjacent to the free end of the spring bar. The cam prevents displacement of the free end beyond a predetermined range of displacement.

7 Claims, 3 Drawing Sheets

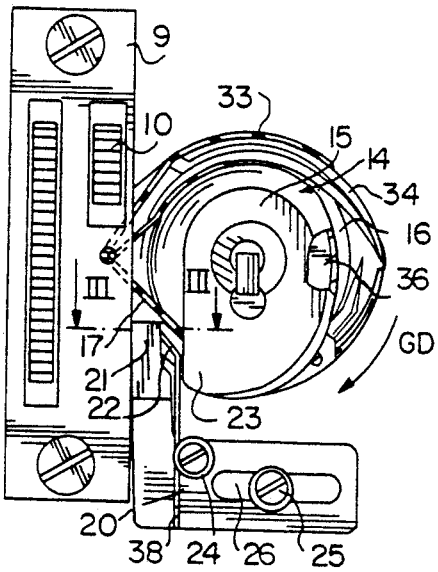
FIG. 2
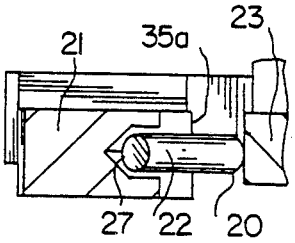
FIG. 3
FIG. 4
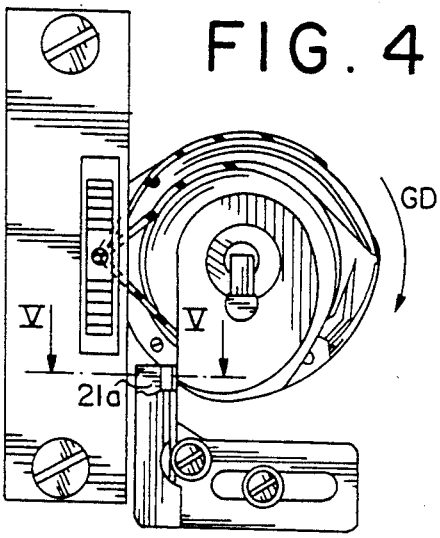
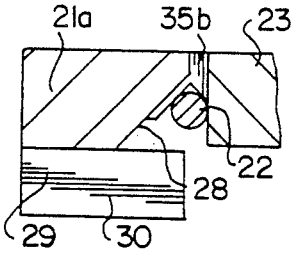
FIG. 5

BOBBIN HOUSING ASSEMBLY IN A SEWING MACHINE HAVING AT LEAST ONE HOOK

This is a continuation of application Ser. No. 138,590, filed on Dec. 28, 1987, now abandoned.

BACKGROUND OF THE INVENTION

1. Field of the Invention

The present invention relates to a bobbin housing assembly in a sewing machine having at least one hook, and a tension spring which rests against the bobbin housing, and advantageously relates to a lockstitch sewing machine of this type.

2. Description of Related Art

A lockstitch sewing machine having a hook, a bobbin housing assembly which includes the hook, and a spring bar, is disclosed in Federal Republic of Germany Patent 34 46 547, having a U.S. counterpart U.S. Pat. No. 4,691,650. In this device, the spring bar rests against the bobbin housing. The spring bar is fastened to a carrier which, in turn, is fastened to the base plate of the lockstitch sewing machine. The carrier furthermore has two cams which are arranged essentially in the center region of the loop press-off side of the bobbin housing and which receive the spring bar between them. The obliquely directed spring bar assumes a position with respect to the cam which is towards the rear in the direction of rotation of the hook body, so that a larger clearance is always present between the free end of the spring bar and the surface of the rear cam facing it.

This device has the following disadvantage. In a lockstitch sewing machine operating with a high stitching rate, the spring bar begins to oscillate, and as a result, the position of the bobbin housing, which itself is held by the spring bar, becomes unstable. As a result of this, defects can arise in the sewing.

Another lockstitch sewing machine having a hook and a spring bar resting against the bobbin housing is disclosed in Federal Republic of Germany Patent 26 16 738, having U.S. counterpart U.S. Pat. No. 4,137,858. In this device, the bobbin housing has a holding finger which is received by two stops provided on a bottom side of the throat plate of the lockstitch sewing machine. Because of the relatively narrow passage clearances between the two stops and the holding finger, passage of the loop of the needle thread (top thread) can be impeded. Furthermore, the manner of operation of this spring bar is also not substantially vibration-free.

SUMMARY OF THE INVENTION

The principal object of the invention is to develop a tension spring bar assembly for the bobbin housing of a lockstitch sewing machine having at least one hook, with vertically mounted hook shaft, which operates substantially free of vibration.

In accordance with the invention, this is achieved by a sewing machine, comprising a base having a throat plate mounted therein; a rotating hook mounted in the base below the throat plate for holding and looping a top thread in a looping direction, the hook enclosing a bobbin housing for accommodating a bottom thread; spring means mounted in the base having a free end for bearing against the bobbin housing and said free end being displaceable by said top thread held in said hook; and cam means disposed in the base closely adjacent to said free end of the spring means, for preventing displacement of said free end, beyond a predetermined range of displacement. The cam means is for preventing uncontrolled oscillation movement of said free end of said spring means.

Advantageously, said cam means comprises a cam secured to said base; said spring means comprises a spring bar secured at a first end to said cam and bearing at said free end against said bobbin housing; and said cam has a resting surface disposed closely adjacent to said free end of said spring bar, and effective for positively guiding the free end of the spring means. The resting surface is preferably disposed at most substantially 0.3 mm from said free end.

The spring bar of the invention is provided with a leg having a free end, which is movable through a maximum clearance of about 0.3 mm, to come against a stop surface of a cam and thereby be quieted. With this device, vibration-free operation is now possible.

Furthermore, according to the invention, the rotation of the bobbin housing in the direction of rotation (GD) is prevented if the needle thread sticks in the hook race. This feature prevents the bobbin housing from being jammed in this situation.

An arrangement of the invention comprises a sewing machine including: a base having a throat plate mounted therein; a rotating hook mounted in the base below the throat plate for holding and looping a top thread in a looping direction, the hook enclosing a bobbin housing for accommodating a bottom thread; spring means mounted in the base having a free end for bearing against the bobbin housing and said free end being displaceable by said top thread held in said hook; and cam means disposed in the base closely adjacent to said free end of the spring means, for preventing displacement of said free end, beyond a predetermined range of displacement, said cam means comprising a cam secured to said base; said spring means comprising a spring bar secured at a first end to said cam and bearing at said free end against said bobbin housing; and said cam having a resting surface disposed closely adjacent to said free end of said spring bar, said resting surface being effective for positively guiding said free end of said spring means.

BRIEF DESCRIPTION OF THE DRAWINGS

Other objects, features and advantages of the invention will be appreciated from the following detailed description of embodiments thereof, with reference to the drawings, in which:

FIG. 2 is a top view of a hook of a single-needle lockstitch sewing machine, a free end of a spring bar being enclosed within a V-shaped notch in a cam;

FIG. 3 is a sectional view along the section line III—III in FIG. 2, shown on a larger scale;

FIG. 4 is a top view of the hook of a single-needle lockstitch sewing machine, wherein the free end of the spring bar comes against an obliquely extending edge of a cam at the end of its swinging movement;

FIG. 5 is a sectional view along the section line V—V of FIG. 4, shown on a larger scale;

DESCRIPTION OF THE PREFERRED EMBODIMENTS

Figure 1:
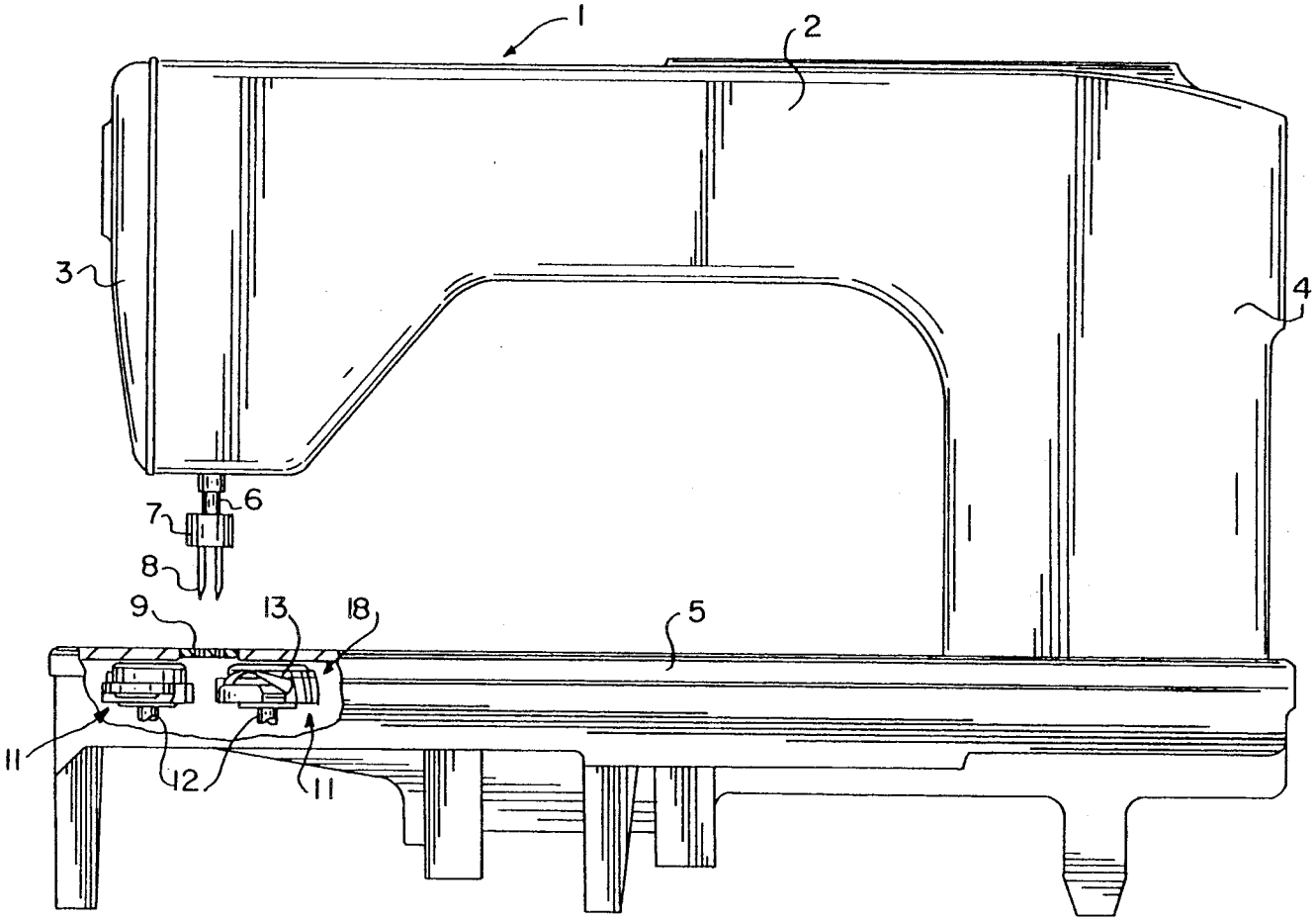
FIG. 1 is a simplified side view of a two-needle lockstitch sewing machine having two verticalshaft hooks.

In FIG. 1, the reference number 1 designates a known lockstitch sewing machine, comprising an arm 2, an arm head 3, a stand 4 and a base plate 5. In the arm head 2, there is mounted a needle bar 6 which can move up and down. On the end of the needle bar 6 is fastened a needle holder 7 which receives two sewing needles 8. A throat plate 9 is mounted in the base plate 5. In a known manner, the sewing needles 8 and the toothed transport ribs of a feed dog 10 pass through the throat plate 9.

As the broken-away portion in FIG. 1 shows, mounted in the base plate 5 are two hooks 11, the drive shafts 12 of which are arranged vertically. For this reason, they are also referred to as vertical-shaft hooks.

Referring now to FIG. 2, each hook 11 comprises a rotating hook body 13 and a bobbin housing 14 therein, which, in turn, comprises an upper part 15 and a lower part 16. Within the latter is mounted, in a known manner, a bobbin 36 which receives a hook thread (bottom thread) 17.

The drive of the hooks 11 is of a known type. The manner in which a needle thread (top thread) loop 33 is received by a hook point 34 which forms part of the hook body 13, and the moving of the needle thread loop 33 around the bobbin housing 14, are also sufficiently well-known that a more extensive description thereof can be dispensed with here.

Below the throat plate 9, there can be provided a thread cutting device 18, shown schematically in FIG. 1, the manner of action of which is well known. The thread cutting device 18 comprises a stationary cutting knife (not shown) and a swingable thread catcher 19, shown in FIG. 6. The manner of operation of an appropriate thread cutting device 18 is described, for example, in Federal Republic of Germany Utility Model 86 30 911.

Figure 8:
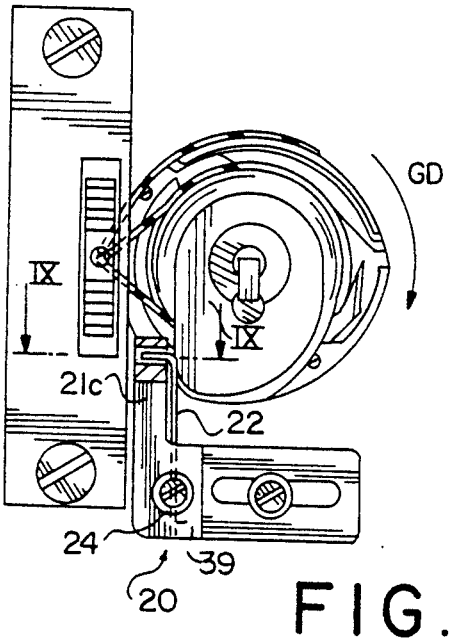
FIG. 8 is a top view of the hook of a lockstitch sewing machine, wherein the spring bar is received in a hole in a cam.
Figure 9:
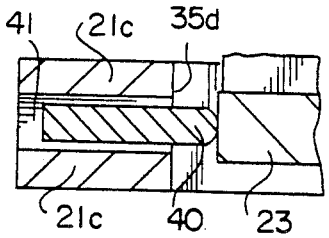
FIG. 9 is a sectional view along the section line IX—IX of FIG. 8, shown on a larger scale.

In order to hold the bobbin housing 14 fast during the rotating movement of the hook body 13, a spring bar 20 is provided. In the various embodiments of this invention, the spring bar 20 has a non-spring part which is received by a portion of a cam 21, 21*a*, 21*b* or 21*c* (hereinafter jointly identified as cams 21) for example, a notch 38 (FIGS. 2–7), or a hole 39 (FIGS. 8–9). The spring bar 20 is fastened by a screw 24 to any of the cams 21 so that the free end of a leg 22 forming part of the spring bar 20 rests against a holding nose 23 on the upper housing part 15.

A slot 26 in any of the cams 21 permits the displacement of the spring bar 20 relative to the holding nose 23 after loosening a screw 25. Each of the cams 21 is firmly attached by a screw 25 to the base plate 5.

Between the free end of the leg 22 and a resting surface of any of the cams 21, which faces it, there is provided a small clearance of at most about 0.3 mm.

The portion of each of the cams 21 for receiving the free end of the spring bar can take several forms. In accordance with FIGS. 2 and 3, a V-shaped notch 27 is provided in the cam 21 in the region of the resting surface.

In the embodiment of FIGS. 4 and 5, an obliquely extending edge 28 on the cam 21*a* and a plate 30 are provided there, together forming the resting surface.

Figure 6:
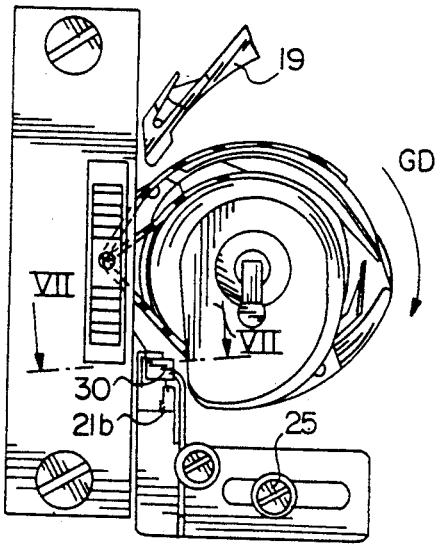
FIG. 6 is a top view of the hook of a single-needle lockstitch sewing machine, wherein the free end of the spring bar is held laterally by two plates which are arranged on a cam.
Figure 7:
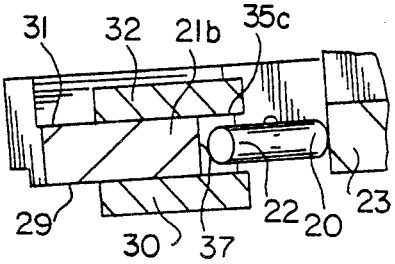
FIG. 7 is a sectional view along the section line VII—VII of FIG. 6, shown on a larger scale.

In FIGS. 6 and 7, a plate 30 is provided on a lower side 29 of the cam 21*b* and another plate 32 is provided on an upper side 31. The plates 30 and 32, which are firmly connected in any suitable manner to the cam 21*b* by bonding or soldering, receive the leg 22 of the spring bar 20 between them, as shown in FIG. 7. The plate 32 is so developed that it does not prevent the swinging motion of the thread catcher 19, which forms part of the thread-cutting device 18.

With the embodiment shown in FIG. 8, a bent-off leg 40 of the spring bar 20 fastened to the cam 21*c* extends into a hole 41 provided in the cam 21*c*, as a result of which the leg 40 is guided laterally during its swinging motion.

The manner of operation of the spring bar 20, in combination with any of the cams 21, will now be described:

At the start of the formation of a stitch, the needle thread loop 33 is taken up in known manner by the hook point 34, and then moved around the bobbin housing 14. When the loop 33 has completed at least about 70 percent of its passage around the bobbin housing 14, it lies directly in front of the narrow space between the leg 22 of the spring bar 20 and the holding nose 23. At this time, the amount of top thread required for the needle thread loop 33 to completely wrap around the bobbin housing 14 has already been withdrawn from a thread lever (not shown), which is movable up and down and provided in known manner in the arm head 3. The corresponding part of the needle thread loop 33 now comes between the holding nose 23 and the leg 22 at the free end of the spring bar 20, the leg 22 moving for a short time away from the holding nose 23; i.e., the leg 22 carries out a slight swinging motion.

Towards the end of this swinging motion, the free end of the leg 22 rests, as shown in FIG. 3, against the V-shaped notch 27 of the cam 21; or, as shown in FIG. 5, against the obliquely extending edge 28 of the cam 21*a* and against the inside of the plate 30; or, in accordance with FIG. 7, against the edge 37 of the cam 21*b*; or, in accordance with FIGS. 8 and 9, the bar 40 is girded between the resting surfaces on the cams 21*c*. Each of these supports is located at most about 0.3 mm behind the leg 22. By each of the supports which have just been described, the leg 22 of the spring bar 20 is immediately quieted again after its swinging motion, so that no undesired oscillation of the spring bar 20 or instability of the bobbin housing can occur.

In the event the needle thread sticks in the hook race, and thus the hook body 13 and the bobbin housing 14 are blocked, the holding nose 23 first of all presses the leg 22 against the resting surface on any of the cams 21. Thereupon, in the embodiment shown in FIGS. 4 and 5, the holding nose 23 comes against a stop edge 35*b* provided on the cam 21*a*, and as a result, further rotation of the bobbin housing 14 in the direction of rotation (GD) of the hook body 13 is prevented. In the embodiments in accordance with FIGS. 2, 3 and 6–9, upon such sticking of the needle thread, the bobbin housing 14 is held fast in the manner that the holding nose 23 presses via the leg 22 against the stop edge 35*a* (FIG. 3) or 35*c* (FIG. 7) or 35*d* (FIG. 9).

If, upon the replacement of an empty bobbin 36 by a full bobbin, the lower part 16 of the bobbin housing 14 should, by mistake, be shifted, then — in order to be able to insert the upper part 15 again in functionally correct position — the lower part 16 must be rotated into a position which is indicated by a marking provided on the lower part 16.

Although illustrative embodiments of the invention have been disclosed herein, it is to be understood that the invention is not limited to such embodiments. Rather, modifications and variations thereof may occur to one of ordinary skill in the art, still within the scope of the invention, as defined in the claims.

What is claimed is:

1. A sewing machine, comprising:

base having a throat plate mounted therein;

a rotating hook mounted in the base below the throat plate for holding and looping a top thread in a looping direction, the hook enclosing a bobbin housing for accomodating a bottom thread;

a spring bar having a fixed end mounted in the base and having a free end for bearing against the bobbin housing; and said free end being displaceable by said top thread held in said hook; and guide-and-stop means mounted in the base and including a cam surface for guiding movement of the free end of said spring element when displaced by said top thread and for engaging said free end and thereby stopping said movement of said free end when such movement has defined a predetermined displacement of said free end, whereby said movement of said free end is limited to prevent unwanted oscillation of said free end.

2. A sewing machine as in claim 1, wherein said predetermined displacement is at most substantially 0.3 mm.

3. A sewing machine as in claim 1, wherein said guide-and-stop means comprises notch means for receiving said free end, formed by an oblique edge of a first element facing said free end, and a plate element adhered to said first element adjacent to said oblique edge.

4. A sewing machine as in claim 1, wherein said guide-and-stop means comprises notch means for receiving said free end, formed by a pair of plates adhered to top and bottom portions of a first element, said notch means facing said free end and being defined between said plates.

5. A sewing machine as in claim 1, wherein said guide-and-stop means comprises notch means for receiving said free end, formed by a hole in a first element facing said free end, and said free end being shaped for projecting into said hole.

6. A sewing machine as in claim 5, wherein said fixed end of said spring bar is secured in a further hole in said first element.

7. A sewing machine as in claim 1, wherein said cam surface comprises notch means having a V-shape for receiving said free end.

* * * * *